US010646044B2

(12) United States Patent
Jones

(10) Patent No.: US 10,646,044 B2
(45) Date of Patent: May 12, 2020

(54) CUSHION

(71) Applicant: Seating Direct International Limited, Bristol (GB)

(72) Inventor: Simon Russell Jones, Bristol (GB)

(73) Assignee: SEATING DIRECT INTERNATIONAL LIMITED, Bristol (GB)

( * ) Notice: Subject to any disclaimer, the term of this patent is extended or adjusted under 35 U.S.C. 154(b) by 500 days.

(21) Appl. No.: 15/362,871

(22) Filed: Nov. 29, 2016

(65) Prior Publication Data

US 2017/0150819 A1 Jun. 1, 2017

(30) Foreign Application Priority Data

Nov. 30, 2015 (GB) ..... 1521074.3

(51) Int. Cl.

| | |
|---|---|
| ***A47C 7/02*** | (2006.01) |
| ***A47C 27/10*** | (2006.01) |
| ***A47C 7/14*** | (2006.01) |
| ***A47C 7/18*** | (2006.01) |

(52) U.S. Cl.

CPC ..... *A47C 7/021* (2013.01); *A47C 7/14* (2013.01); *A47C 7/18* (2013.01); *A47C 27/10* (2013.01)

(58) Field of Classification Search

CPC .. A47C 7/02; A47C 7/021; A47C 7/14; A47C 7/18; A47C 27/00; A47C 27/08; A47C 27/10

See application file for complete search history.

(56) References Cited

U.S. PATENT DOCUMENTS

| | | | | |
|---|---|---|---|---|
| 3,982,786 | A | 9/1976 | Burgin | |
| 3,987,506 | A * | 10/1976 | Markwitz | A61H 37/00 601/149 |
| 5,785,669 | A * | 7/1998 | Proctor | A47C 7/425 297/284.6 |
| 7,048,703 | B2 * | 5/2006 | Riach | A61F 5/012 128/845 |
| 7,437,789 | B2 * | 10/2008 | Thompson | A47C 7/467 5/626 |
| 2011/0025111 | A1 | 2/2011 | Wornell | |

(Continued)

FOREIGN PATENT DOCUMENTS

| | | |
|---|---|---|
| DE | 2642259 B1 | 1/1978 |
| EP | 0116470 A1 | 8/1984 |

(Continued)

OTHER PUBLICATIONS

Extended European Search Report dated Apr. 28, 2017 in related application EP 16200821.3, 8 pages.

*Primary Examiner* — Robert G Santos
*Assistant Examiner* — Rahib T Zaman
(74) *Attorney, Agent, or Firm* — Stuart H. Mayer; Mayer & Williams PC

(57) ABSTRACT

A fluid-fillable cushion comprises upper and lower layers, a first chamber and a second chamber and a discrete pressure distributing unit situated between the upper and lower layers, said pressure distributing unit providing a fluid connection between at least the first chamber and the second chamber. Such a cushion reduces leaks and allows controlled pressure equalisation between the chambers. Also disclosed is a process for making such cushions and seating products comprising such cushions.

12 Claims, 3 Drawing Sheets

(56) References Cited

U.S. PATENT DOCUMENTS

| | | | | |
|---|---|---|---|---|
| 2013/0328376 | A1 | 12/2013 | Lee | |
| 2014/0054948 | A1* | 2/2014 | Bachar | A47C 7/02<br>297/452.48 |
| 2015/0113735 | A1 | 4/2015 | Anderson | |
| 2015/0164229 | A1 | 6/2015 | Popp | |
| 2015/0366368 | A1 | 12/2015 | Cheng | |

FOREIGN PATENT DOCUMENTS

| | | | |
|---|---|---|---|
| JP | 2003275065 | A | 9/2003 |
| WO | 9641556 | A1 | 12/1996 |
| WO | 2004/006727 | A1 | 1/2004 |
| WO | 2009/124236 | A1 | 10/2008 |

* cited by examiner

CUSHION

FIELD OF THE INVENTION

The present invention relates to cushions, in particular to fluid-fillable cushions and parts thereof. The present invention also relates to processes for making such cushions and to seating products comprising such cushions.

DESCRIPTION OF THE RELATED ART

Many people suffer from lower back pain and require some form of postural support to help alleviate their discomfort. Incorrectly designed seating can cause poor posture, which can lead to pressure on the lower spine. The problem is exacerbated by today's often sedentary lifestyle.

Good ergonomic seating can reduce the risk of stress and injury to muscles and joints, encouraging movement, variety and flexibility, and providing long-term comfort and improved back health.

US-A-2011/0025111 describes a chair or seat comprising one or more self-inflatable devices inserted within the chair or seat. Each inflatable device comprises a flexible, open celled foam filled single bladder connected to a control valve and optionally a bleed valve.

WO-A-2009/124236 relates to a seating product comprising a combination of springs and inflatable single bladders in the lumbar region of the back area and in the seating area. Each bladder is coupled to a pump for inflation and deflation.

US-A-2015/0113735 describes a hybrid seating cushion made up of a cushion base and a cushion insert. The cushion insert, such as an air bladder or fluid sack is positioned within a void within the cushion base.

US-A-2015/0164229 describes a permanently-inflated seat cushion comprising many air-filled chambers, in which each chamber is a sealed unit.

US-A-2013/0328376 describes a self-inflating cushion bladder comprising an airtight envelope containing a compressible material, which is in air communication with a displacement bladder to form an airtight system.

Fluid-filled cushions may comprise a single chamber, so there is unrestricted flow of the fluid around the cushion. These single chamber cushions require only a few components and are simple to manufacture. However, unrestricted flow of fluid can be problematic, as too much movement of the fluid under the weight of the user can lead to rapid and uneven fluid distribution, resulting in poor support for the user.

In order to try and overcome the problem of unrestricted fluid movement, some cushions comprise many small chambers in fluid connection with one another. The connections between the chambers are usually created by leaving a break in the seal between the chambers. This method has the advantage of being simple and low cost. However, each break in the seal creates a weak point and increases the likelihood of a leak from the cushion under the fluid pressure within the cushion and under the weight of the user. Any leak in the seal is a particular problem where the cushion is built-in to an expensive chair.

Further, where the connections are formed by leaving a break in the seal between the chambers, the diameter of the aperture will expand or contract depending on the pressure within the cushion. This leads to a varying degree of fluid distribution within the cushion and a correspondingly varied level of support for the user. Further, the weight of the user may partially close off an aperture, again leading to uneven fluid movement within the cushion and poor support for the user.

Therefore, there exists a need to provide an efficient and reliable method of distributing fluid around a fluid-filled cushion.

It is an aim of the present invention to address this need.

BRIEF SUMMARY OF THE INVENTION

The present invention accordingly provides, in a first aspect, a cushion (preferably a fluid-fillable or fluid filled cushion) comprising: an upper layer and a lower layer; at least a first chamber and a second chamber; and at least one pressure distributing unit situated between the upper and lower layers, said pressure distributing unit providing a fluid connection between at least the first chamber and the second chamber, and wherein the pressure distributing unit is a discrete unit.

Preferably, the pressure distributing unit comprises a frame and one or more fluid conduits, the fluid conduits for enabling fluid to flow, preferably in a controlled fashion, between the first chamber and the second chamber.

The conduits of the pressure distributing unit are suitable to allow flow of a fluid, such as gas, gel or liquid between the chambers to equalise pressure.

The use of the discrete pressure distributing unit is advantageous because it reduces the likelihood of a leak from the cushion under the fluid pressure within the cushion and under the weight of the user and also provides for more consistent and even, preferably controlled, fluid flow and thus better support for the user.

Preferably, the conduits are evenly spaced within the frame. This is advantageous because the even spacing of the conduits may achieve an even distribution of pressure between the chambers of the cushion, thereby providing optimal comfort and support for the user. There may be one or a plurality of fluid conduits. Examples of the number of fluid conduits in each pressure distributing unit are: 2, 3, 4, 5, 6, 7, 8, 9, 10.

Preferably, the fluid conduits comprise tubes arranged in, and fixed to, the frame.

The fluid conduits may have differing diameters (either external diameter or aperture/diameter). However, more preferably, each fluid conduit has substantially the same aperture/bore diameter. This is advantageous as the constant diameter of the conduits helps to achieve an even, and generally controlled, distribution of fluid across the pressure distributing unit, thereby providing optimal comfort and support for the user.

In use, preferably, the first chamber and second chamber will contain fluid, the fluid being selected from a gel, a gas, a liquid and a mixture thereof. The preferred gas is air.

The aperture diameter of the fluid conduits may vary depending upon the fluid to be used in the cushion. For example, gel is often more viscous than liquid and so the aperture would generally be greater to allow relatively easy flow of the gel between the chambers. Similarly, liquid often flows less well than gas and so the aperture would generally be greater for liquids than for gases. The size of the aperture is therefore preferably optimised depending upon the fluid used to ensure efficient, and preferably controlled, flow between chambers to provide even support for the user.

When the fluid is a gel, the size (mm) of the aperture is preferably in the range 4 to 16, more preferably 6 to 14, even more preferably 8 to 12, and most preferably 9 to 11.

When the fluid is a liquid, the size (mm) of the aperture is preferably in the range 1.5 to 8.5, more preferably 2.5 to 7.5, even more preferably 3.5 to 6.5, and most preferably 4 to 6 or 4.0 to 6.0.

When the fluid is a gas, the size (mm) of the aperture is preferably is in the range 0.5 to 5.5, more preferably 1.5 to 4.5, even more preferably 2 to 4, and most preferably 2.5 to 3.5.

Preferably, the conduits comprise a polymer, and preferably a thermoplastic polymer. Preferably, the thermoplastic polymer may be selected from polyvinyl chloride (PVC), thermoplastic polyurethane (TPU), polyamide (PA) (e.g. nylon), polyethylene terephthalate (PET), poly(ethylene-vinyl acetate) (PEVA), ethylene-vinyl acetate (EVA) and acrylonitrile butadiene styrene (ABS). More preferably, the thermoplastic polymer is TPU. TPU may comprise polyether TPU or polyester TPU. Most preferably, the thermoplastic polymer comprises polyester TPU.

Use of such polymers allows hardness and thickness of the material of the conduits to be such that they can withstand the internal pressure of the cushion and the weight of the user without collapsing. This is advantageous because the size of the conduit aperture remains relatively constant thereby providing a constant and reliable level of support for the user. Furthermore, the resilient nature of the polymers allows the fluid conduits to be relatively undistorted even under the pressure created by inflating the cushion and the weight of the user, thereby significantly decreasing any chance of a pressure leak. This is particularly advantageous when the cushion is difficult or expensive to replace such as one which has been incorporated into a high-value office chair or a specialised seating product (e.g. a wheelchair).

The frame of the pressure distributing unit may similarly comprise a polymer, and preferably a thermoplastic polymer. Preferably, the thermoplastic polymer may be selected from polyvinyl chloride (PVC), thermoplastic polyurethane (TPU), polyamide (PA) (e.g. nylon), polyethylene terephthalate (PET), poly(ethylene-vinyl acetate) (PEVA), ethylene-vinyl acetate (EVA) and acrylonitrile butadiene styrene (ABS). More preferably, the thermoplastic polymer is TPU. TPU may comprise a polyether TPU or polyester TPU. Most preferably, the thermoplastic polymer comprises polyester TPU.

Preferably, the conduits and frame are formed from the same polymer and preferably as a single piece (e.g. in a single process), by, for example injection moulding or extrusion.

Preferably, the polymer(s) used for the conduits and frame has/have a Shore hardness (D) preferably in the range 40 to 95, more preferably 55 to 80, more preferably 60 to 75, and most preferably 65 to 70. Shore hardness (D) may be determined by a durometer generally according to ASTM D2240.

Preferably, the polymer(s) used for the conduits and frame has/have a specific gravity (g/cm$^3$) preferably in the range 1 to 1.55, more preferably in the range 1.1 to 1.45, more preferably in the range 1.2 to 1.35, and most preferably 1.25 to 1.30. Specific gravity may be determined generally according to ASTM D792.

Preferably, the polymer(s) used for the conduits and frame has/have a tensile stress (kgf/cm$^2$) at 100% elongation preferably in the range 220 to 340, more preferably in the range 240 to 320, even more preferably in the range 260 to 300, and most preferably in the range 270 to 290; and at 300% elongation preferably in the range 320 to 480, more preferably 350 to 450, even more preferably 380 to 420, and most preferably 390 to 410. Tensile stress may be determined generally according to ASTM D412.

Preferably, the polymer(s) used for the conduits and frame has/have a tensile strength (kgf/cm$^2$) preferably in the range 350 to 550, more preferably 400 to 500, even more preferably 420 to 480, and most preferably 440 to 460. Tensile strength may be determined generally according to ASTM D412.

Preferably, the polymer(s) used for the conduits and frame has/have an ultimate elongation (%) preferably in the range 350 to 520, more preferably in the range 380 to 490, more preferably 400 to 470, and most preferably 420 to 440. Ultimate elongation may be determined generally according to ASTM D412.

Preferably, the polymer(s) used for the conduits and frame has/have a tear resistance (Die C) (kgf/cm) preferably in the range 180 to 320, more preferably in the range 200 to 300, even more preferably in the range 220 to 280, and most preferably in the range 240 to 260. Tear resistance may be determined generally according to ASTM D624.

Preferably, the polymer(s) used for the conduits and frame has/have an abrasion loss (mm$^3$ loss) preferably in the range 18 to 32, more preferably in the range 20 to 30, even more preferably in the range 22 to 28, and most preferably in the range 24 to 26. Abrasion loss may be determined generally according to ISO 4649.

Preferably, the polymer(s) used for the conduits and frame has/have a compression set (%) at 23° C.×22 hr preferably in the range 15 to 25, more preferably in the range 17 to 23, even more preferably in the range 18 to 22, and most preferably in the range 19 to 21; and at 70° C.×22 hr preferably in the range 38 to 52, more preferably 40 to 50, even more preferably 42 to 48, and most preferably 44 to 46. Compression set may be determined generally according to ASTM D395.

Preferably, the polymer(s) used for the conduits and frame has/have a mould shrinkage (m/m) preferably in the range 0.004 to 0.008, more preferably 0.0045 to 0.0075, even more preferably 0.005 to 0.007, and most preferably in the range 0.0055 to 0.0065. Mould shrinkage may be determined generally according to ASTM D955.

Preferably, the polymer(s) used for the conduits and frame has/have a Vicat softening temperature (° C.) preferably in the range 145 to 180, more preferably in the range 150 to 175, even more preferably in the range 155 to 170, most preferably in the range 160 to 165. Vicat softening temperature may be determined generally according to ASTM D1525.

Generally, polymer test samples may be annealed at 100° C. and 24 hours at room temperature before testing.

Preferably, the upper and lower layers of the cushion comprise a polymer and preferably a thermoplastic polymer. Preferably, the thermoplastic polymer may be selected from polyvinyl chloride (PVC), thermoplastic polyurethane (TPU), polyamide (PA), nylon, polyethylene terephthalate (PET), poly(ethylene-vinyl acetate) (PEVA), ethylene-vinyl acetate (EVA) and acrylonitrile butadiene styrene (ABS). More preferably, the thermoplastic polymer is TPU. TPU may comprise a polyether TPU or polyester TPU. Most preferably, the thermoplastic polymer comprises polyether TPU.

Polyether TPU is advantageous particularly for use in the upper and lower layers of the cushion of the present invention as it often remains flexible at low temperature (therefore enabling easy inflation and deflation even at low temperature) and is generally resistant to abrasions and tears (thereby decreasing the likelihood of a leak). It is also relatively durable against microbial attack.

The polymer is thus preferably flexible. The advantage of using a flexible polymer/plastic for the upper and lower layers is that it is able to conform to the user's body and may be elastic and so allows repeated inflation and deflation of the cushion without losing material resilience, and so continues to provide effective support for the user.

The thickness of the upper and lower layers may be chosen depending upon the material used and to provide optimum elasticity and strength. For example, the thickness (mm) of the polyether TPU may preferably be in the range 0.1 to 0.5, more preferably 0.15 to 0.45, even more preferably 0.2 to 0.4 and most preferably 0.25 to 0.35.

Preferably, the polymer used for the upper and lower layers has a Shore hardness (A) preferably in the range of 70 to 110, more preferably 75 to 105, even more preferably 80 to 100, and most preferably 85 to 95. Shore hardness (A) may be determined by a durometer generally according to ASTM D2240.

Preferably, the polymer used for the upper and lower layers has a specific gravity preferably in the range of 0.95 to 1.3, more preferably 1.0 to 1.25, even more preferably 1.05 to 1.2, and most preferably 1.1 to 1.15. The specific gravity may be determined by displacement generally in accordance with ASTM D-792.

Preferably, the polymer used for the upper and lower layers has an ultimate (Psi) tensile strength preferably in the range of 3300 to 7500, more preferably 4300 to 6500, even more preferably 5000 to 5800, and most preferably 5300 to 5500. The ultimate tensile strength may be determined generally in accordance with ASTM D-412.

Preferably, the polymer used for the upper and lower layers has an ultimate elongation (%) preferably in the range of 300 to 630, more preferably 350 to 580, even more preferably 400 to 530, and most preferably 450 to 470. The ultimate elongation may be determined generally in accordance with ASTM D-412.

Preferably, the polymer used for the upper and lower layers has a tear strength die "C" (PLi) preferably in the range of 450 to 1000, more preferably 550 to 900, even more preferably 650 to 800, and most preferably 700 to 750. The tear strength die "C" may be determined generally in accordance with ASTM D-624.

Preferably, the polymer used for the upper and lower layers has a Taber abrasion resistance (mg) preferably in the range of 30 to 60, more preferably 35 to 55, even more preferably 40 to 50, and most preferably 43 to 47. The Taber abrasion resistance may be determined generally in accordance with ASTM D-1044.

Preferably, the polymer used for the upper and lower layers has a Vicat softening temperature (° C.) preferably in the range of 80 to 160, more preferably in the range 90 to 150, even more preferably in the range 100 to 140, and most preferably in the range 110 to 130. The Vicat softening temperature may be determined generally in accordance with ASTM D-1044.

Preferably, the polymer used for the upper and lower layers has a glass transition temperature (° C.) preferably in the range −20 to −50, more preferably −25 to −45, even more preferably −30 to −40, and most preferably −33 to −37. The glass transition temperature may be determined generally using differential scanning calorimetry (DSC).

Preferably, the frame of the pressure distributing unit and the upper and lower layers of the cushion are welding-compatible, i.e. compatible for the purposes of welding. For example, polyether TPU and polyester TPU are compatible for welding. This is advantageous because during manufacture of the cushion, the upper and lower layers of the cushion and the pressure distributing unit can be efficiently and effectively sealed together in one operation using the same welding method, therefore speeding up the manufacturing process.

Preferably, the cushion further comprises a compressible pad between the upper and lower layers.

The compressible pad may comprise a solid foam, such as a polyurethane foam, which may be an open cell foam or a closed cell foam. The advantage of including a compressible pad is that further support is created for the user due to the resilience of the foam, in addition to the support already provided by the internal fluid pressure. An open cell foam is advantageous in that it can expand and contract depending upon the pressure inside the cushion and therefore allows greater flexibility of control for the user.

In some embodiments of the invention, it is advantageous if the cushion further comprises a pressure release valve and/or a pump. If the fluid to fill the chambers of the cushion is a gas (e.g. air), the cushion of the present invention may further comprise an air pump and air pressure release valve. This is advantageous as the cushion may be easily inflated or deflated to meet the changing requirements of a single user, or the requirements of different users. The pump may be manually operated or motorised. A pressure release valve (e.g. air pressure release valve) is advantageous because the level of (air) inflation of the cushion may be controlled to suit the individual needs of the user. Generally, inflation of the cushion relies on the elasticity of the upper and lower layers of the cushion and, if present, the expansion of the compressible pad.

In other embodiments, the cushion may be fully (permanently) sealed so that the fluid content (and depending on the fluid, volume) of the cushion remains the same thereby providing a uniform level of support for the user. In this case, the fluid may be a liquid, a gel or a gas.

The present invention provides, in a second aspect, a seating product comprising one or more cushions according to the first aspect of the invention. The seating product may comprise a cushion in the seat (including the thigh region), the lumbar region, the thoracic region, and the head and neck region.

Each cushion in the seating product may be selectively and individually inflated to provide a customised support in the seating product. Examples of seating products include office chairs, armchairs, specialised chairs (such as wheelchairs) and any other kind of seating product. The cushion may be covered with a fabric to be used as a portable cushion. The cushions of the invention may also be incorporated into mattresses.

The present invention further provides, in a third aspect, a seating product comprising one or more pressure distributing units as discussed in relation to the first aspect of the invention. The pressure distributing units may be contained within cushions according to the present invention.

The present invention further provides, in a fourth aspect a process for the manufacture of a cushion according to the first aspect of the invention, wherein the pressure distributing unit is placed between the upper and lower layers, and the upper and lower layers are sealed together to create two or more chambers, and wherein the pressure distributing unit provides a fluid connection between the chambers.

The present invention further provides, in a fifth aspect a process for the manufacture of a cushion, the process comprising, a) providing a first layer and a second layer, b) providing a discrete pressure distributing unit comprising a frame and one or more fluid conduits, c) arranging the pressure distributing unit on the first layer, d) placing the second layer on the first layer and pressure distributing unit, and e) sealing the first and second layers together to form a first chamber and a second chamber with the pressure distributing unit sealed between the first chamber and the second chamber, thereby providing a fluid connection between the first and second chambers.

Preferably, the sealing method is selected from adhesive bonding and welding, such as heat welding or high frequency welding. More preferably, the sealing method comprises high frequency welding.

In high frequency welding (HF welding), layers of thermoplastic polymers (plastics) are heated using high frequency electromagnetic (radio) waves to soften and weld the plastics together. The die and table press comprise metal plates (preferably made of brass) which mate together and direct the welding process and the specific shape of the seal. Two or more layers of plastic are placed on a table press, the plates are moved together and high frequency waves (often around 27 MHz) are passed through the small area between the die and the table press. The high frequency waves cause the molecules in the plastic to vibrate heat, and in combination with pressure, the plastic is welded to the shape of the plates. The profile of the plates may be adapted to provide a strong weld and to ensure that the pressure distribution unit is sealed between the upper and lower layers of the cushion and that the two (or more) chambers are formed.

HF welding advantageously enables fast, localised and accurate welding of plastics, generally resulting in a consistently strong and leak-proof seal. This is of course important for the cushion of the present invention, which must withstand internal pressure and pressure from the weight of the user.

Examples of suitable machines for high frequency welding include those designed by the companies Radyne and Geaf s.r.l.

The shape of the cushion can be varied depending on what part of the body the cushion is intended to support. Preferably, the cushion comprises two chambers of a similar size separated by one pressure distribution unit.

As discussed above, the conduits and frame are formed in one piece in a discrete pressure distributing unit. If the conduits and frame were separate pieces, which needed to be assembled to form the pressure distributing unit, manufacturing times would be slower and the manufacturing process inefficient. Therefore, and advantageously, each pressure distributing unit can be pre-made to a uniform standard and, during manufacture of the cushion, can be placed between the upper and lower layers at the correct position before sealing, therefore speeding up the manufacture process.

The present invention further provides, in a sixth aspect, a pressure distributing unit comprising one or more conduits and a frame, in which the pressure distributing unit is suitable for providing a fluid connection between the chambers of a cushion according to the first aspect of the invention. Preferably, the conduits and frame are formed as a single piece as a discrete pressure distributing unit.

The pressure distributing unit is a discrete unit, which provides a simple and efficient means for distributing fluid between the chambers of the cushion. During manufacture of a cushion of the present invention, the pressure distributing unit can simply be placed between the upper and lower layers of the cushion, and following sealing of the cushion, the pressure distribution unit is in place and provides a fluid connection between the chambers.

The size of the pressure distributing unit and the number of conduits can be varied depending on the size of the cushion.

BRIEF DESCRIPTION OF THE DRAWINGS

The present invention will now be described by way of example only, and with reference to, the accompanying drawings, in which.

DETAILED DESCRIPTION OF THE INVENTION

Figure 1:
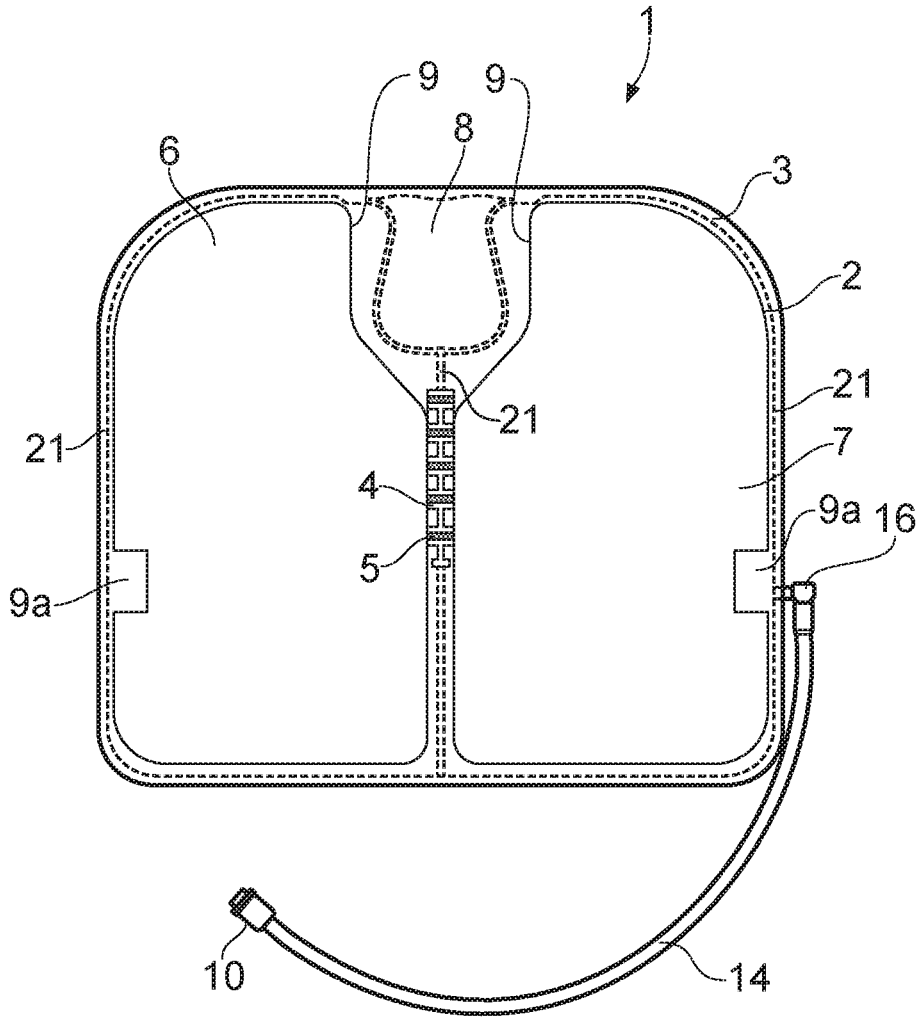
FIG. 1 illustrates a plan view of an embodiment of a cushion according to the present invention.

FIG. 1 shows a cushion 1 of the present invention. The cushion 1 is intended to be used in the seat of a chair, and includes a coccyx cut-out region 8 to accommodate the base of the spine for user comfort and a first fluid fillable chamber 6 and a second fluid fillable chamber 7, separated by the pressure distributing unit 5. The use of two chambers 6,7 with a pressure distributing unit 5 allows distribution of fluid at an optimum and controlled rate around the cushion, generally producing an even pressure on both sides of the cushion thereby providing even support for the user. The pressure distributing unit 5 has fluid conduits 4 to allow fluid to flow between the chambers 6, 7. In the case of the cushion illustrated in FIG. 1, air is the fluid that fills the two chambers 6, 7 of the cushion 1, the pressure distributing unit 5 allowing controlled flow and generally equalisation of pressure between the two chambers 6, 7.

The cushion 1 comprises a compression pad 9 of a solid open cell foam of polyurethane located between a second, lower layer 3 and first, upper layer 2 each layer 2,3 being of flexible, transparent, tough and resilient polyether thermoplastic polyurethane having a Shore hardness 90A and an ultimate tensile strength of 5400 Psi. The upper layer 2 and lower layer 3 are welded together using high frequency (radio frequency) welding along line 21 thereby forming the first and second chambers 6, 7 and the coccyx cut out 8. The pressure distributing unit 5 is sealed in position by welding.

The compression pad 9 has symmetrical cut-outs 9*a*. In cushion 1, only the second chamber 7 is connected to air outlet 16 attached to the cut-out 9*a* and then by tube 14 to an air pressure release valve 10 for release pressure if required.

Figure 2:
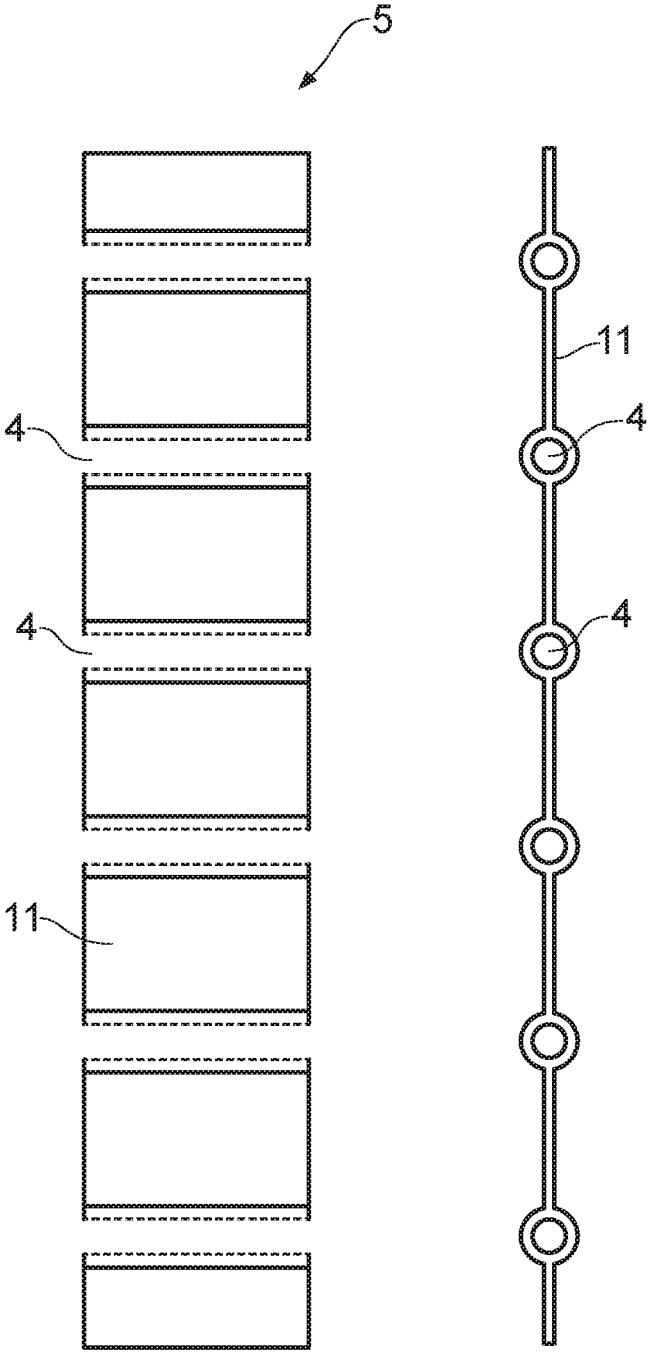
FIG. 2 illustrates a plan view and side view of a pressure distributing unit as used in the present invention.

FIG. 2 shows in more detail a top view and side view of the pressure distributing unit 5 of the present invention, including the frame 11 and the fluid conduits 4. FIG. 2 shows an example of the layout of the fluid conduits 4 in the pressure distribution unit of the present invention, in which the fluid is air and the fluid conduits 4 are six in number and evenly spaced. Of course, the number and spacing of the fluid conduits may be changed depending on intended use. The pressure distributing unit 5 is formed in one piece as a discrete unit, both the fluid conduits 4 and frame being of the same polymer, polyester thermoplastic polyurethane having a Shore hardness (D) of 68, a tensile strength (kg/cm$^2$) of 450 and a mould shrinkage (m/m) of 0.006. The pressure distributing unit 5 may conveniently be formed by injection moulding.

Figure 3:
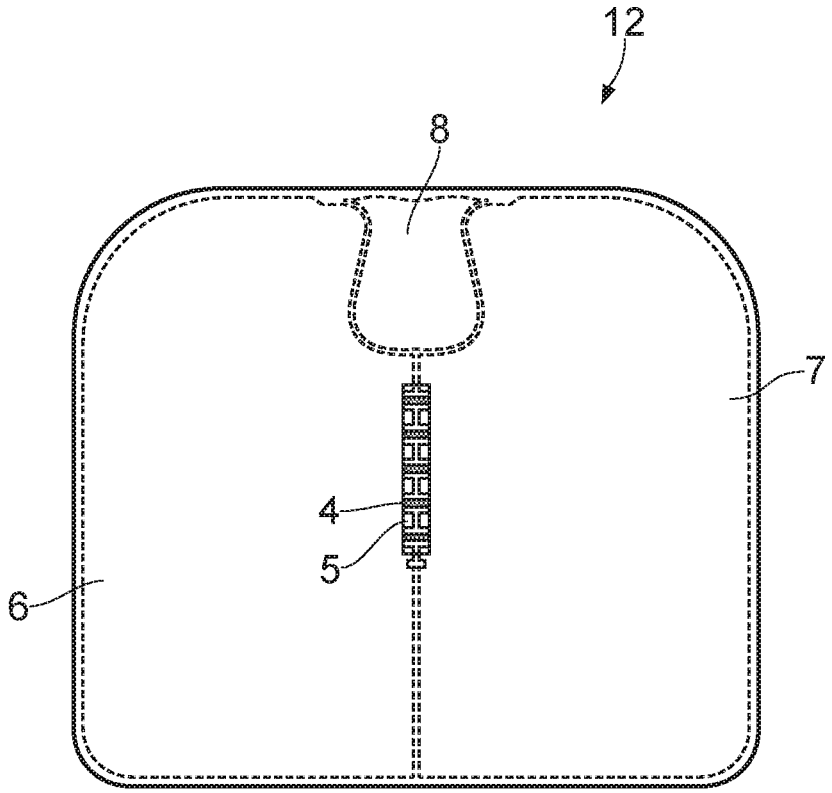
FIG. 3 illustrates a plan view of another embodiment of a cushion according to the present invention.

FIG. 3 shows an example of a sealed cushion 12 of the invention comprising a pressure distributing unit 5 with fluid conduits 4, two chambers 6, 7 and a coccyx cut-out region 8. The welding lines are again shown by a dotted line 21. In this embodiment, the fluid may be a liquid, a gel or a gas.

A cushion according to the invention may be manufactured by use of adhesives or preferably by welding a first sheet/layer and second sheet/layer of a polyether thermoplastic polyurethane (having a Shore hardness 90A) together with a pressure distributing unit (formed of polyester thermoplastic polyurethane by injection moulding) situated between the layers. Generally, a first and second layer of the polyether TPU are cut into suitable shapes and the first layer is laid on to a table press of a high frequency welding machine. The welding machine is provided with suitable dies to form the first and second chambers and weld the frame of the pressure distributing unit in place. The pressure distributing unit is located on the first layer and the second layer placed over the pressure distributing unit and first layer. The table press is then closed and HF energy applied to weld the first and second layer together to form the chambers and also weld the pressure distributing unit in place. Optionally, other components of the cushion as discussed herein may be placed on the first layer, such as one or more compressible pads, and outlet/inlets for a pump (e.g. air pump) and/or pressure release valve. These optional components would then be located appropriately in the cushion after welding.

The invention claimed is:

1. A cushion comprising:

an upper layer and a lower layer;

at least a first chamber and a second chamber;

at least one pressure distributing unit situated between the upper and lower layers, said pressure distributing unit providing a fluid connection between at least the first chamber and the second chamber, and wherein the pressure distributing unit is a discrete unit, comprising a frame and a plurality of fluid conduits, the fluid conduits comprising tubes arranged in the frame, the frame and fluid conduits being formed from the same polymer and formed as a single piece by injection moulding or extrusion, and wherein the fluid conduits are for enabling fluid to flow between the first chamber and the second chamber.

2. The cushion according to claim 1, wherein the fluid conduits are evenly spaced in the frame.

3. The cushion according to claim 1, wherein the first chamber and second chamber contain fluid, the fluid being selected from a gel, a gas, a liquid and a mixture thereof.

4. The cushion according to claim 1, wherein the plurality of fluid conduits and the frame of the pressure distributing unit each comprise a polymer independently selected from polyvinyl chloride (PVC); thermoplastic polyurethane (TPU), wherein TPU is preferably polyether TPU or polyester TPU; polyamide (PA); nylon; polyethylene terephthalate (PET); poly(ethylene-vinyl acetate) (PEVA); ethylene-vinyl acetate (EVA); and acrylonitrile butadiene styrene (ABS); and preferably polyester TPU.

5. The cushion according to claim 1, wherein the upper and lower layers comprise a polymer independently selected from polyvinyl chloride (PVC), thermoplastic polyurethane (TPU), polyamide (PA), nylon, polyethylene terephthalate (PET), poly(ethylene-vinyl acetate) (PEVA), ethylene-vinyl acetate (EVA), and acrylonitrile butadiene styrene (ABS), preferably polyether TPU or polyester TPU and more preferably polyether TPU.

6. The cushion according to claim 5, wherein the polymer of the frame of the pressure distributing unit and the polymer of the upper and lower layers are welding-compatible, preferably high frequency welding compatible.

7. The cushion according to claim 1, wherein the cushion further comprises at least one compressible pad between the upper and lower layers.

8. The cushion according to claim 7, wherein the compressible pad comprises solid foam.

9. A process for the manufacture of a cushion, the process comprising, a) providing a first layer and a second layer, b) providing a discrete pressure distributing unit comprising a frame and a plurality of fluid conduits, the fluid conduits comprising tubes arranged in the frame, the frame and fluid conduits being formed from the same polymer and formed as a single piece of injection moulding or extrusion, c) arranging the pressure distributing unit on the first layer, d) placing the second layer on the first layer and pressure distributing unit, and e) sealing the first and second layers together to form a first chamber and a second chamber with the pressure distributing unit sealed between the first chamber and the second chamber, thereby providing a fluid connection between the first and second chambers.

10. A process according to claim 9, wherein sealing is selected from adhesive bonding and welding.

11. A process according to claim 10, wherein welding is high frequency welding.

12. A process according to claim 9, further comprising b1) arranging at least one compressible pad on the first layer.

* * * * *